US008016047B2

(12) United States Patent
Ookubo et al.

(10) Patent No.: US 8,016,047 B2
(45) Date of Patent: Sep. 13, 2011

(54) ELECTRICAL POWER TOOL WITH ANTI-VIBRATION MECHANISMS OF DIFFERENT TYPES

(75) Inventors: Takahiro Ookubo, Hitachinaka (JP); Tsukasa Suzuura, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 94 days.

(21) Appl. No.: 12/305,681

(22) PCT Filed: Jul. 9, 2007

(86) PCT No.: PCT/JP2007/064037

§ 371 (c)(1),
(2), (4) Date: Dec. 19, 2008

(87) PCT Pub. No.: WO2008/010467

PCT Pub. Date: Jan. 24, 2008

(65) Prior Publication Data

US 2010/0163262 A1 Jul. 1, 2010

(30) Foreign Application Priority Data

Jul. 20, 2006 (JP) ..... P2006-198679

(51) Int. Cl.
*B25D 17/24* (2006.01)

(52) U.S. Cl. ..... 173/162.2; 173/210; 173/162.1

(58) Field of Classification Search ..... 173/210, 173/162.1, 162.2
See application file for complete search history.

(56) References Cited

U.S. PATENT DOCUMENTS 3,850,255 A * 11/1974 Koehler ..... 173/110
4,478,293 A * 10/1984 Weilenmann et al. ..... 173/162.2
6,112,830 A 9/2000 Ziegler et al.
6,581,524 B1 * 6/2003 Morgan et al. ..... 104/10
6,763,897 B2 * 7/2004 Hanke et al. ..... 173/210
(Continued)

FOREIGN PATENT DOCUMENTS

CN 1761553 4/2006
(Continued)

OTHER PUBLICATIONS

"Counterbalance Cuts Saw Vibration", Penton Media, Cleveland, Ohio, US, vol. 62, No. 22, Oct. 25, 1990, XP000212881, ISSN: 0024-9114.

*Primary Examiner* — Brian D Nash
(74) *Attorney, Agent, or Firm* — Antonelli, Terry, Stout & Kraus, LLP.

(57) ABSTRACT

An electrical power tool includes a motor, a casing, a casing, a piston, an intermediate shaft, a motion conversion mechanism, and a plurality of types of anti-vibration mechanism. The motor has a drive shaft. The casing accommodates at least the motor. The piston is driven by a rotary motion of the drive shaft. The intermediate shaft extends parallel to the drive shaft and is driven to rotate by the rotary motion of the drive shaft, the intermediate shaft defining an axial direction. The motion conversion mechanism is disposed on the intermediate shaft and is capable of moving in association with the intermediate shaft for converting the rotary motion of the drive shaft to a reciprocating motion. The motion conversion mechanism includes a first motion conversion mechanism that is connected to the piston and moves the piston in a reciprocating motion in directions substantially parallel to the axial direction of the intermediate shaft. The plurality of types of anti-vibration mechanism is accommodated in the casing.

12 Claims, 6 Drawing Sheets

U.S. PATENT DOCUMENTS

| | | | | |
|---|---|---|---|---|
| 6,962,211 | B2 | 11/2005 | Daubner et al. | |
| 7,096,973 | B2 * | 8/2006 | Ikuta et al. | 173/201 |
| 7,204,322 | B2 * | 4/2007 | Sakai | 173/162.1 |
| 7,383,895 | B2 * | 6/2008 | Aoki | 173/201 |
| 7,451,833 | B2 * | 11/2008 | Hahn | 173/104 |
| 7,500,527 | B2 * | 3/2009 | Fischer et al. | 173/162.2 |
| 7,513,317 | B2 * | 4/2009 | Satou | 173/162.2 |
| 2008/0017395 | A1 * | 1/2008 | Sato | 173/162.2 |
| 2008/0196915 | A1 * | 8/2008 | Stirm et al. | 173/210 |
| 2008/0202785 | A1 * | 8/2008 | Fischer et al. | 173/162.2 |
| 2009/0095499 | A1 * | 4/2009 | Satou et al. | 173/210 |

FOREIGN PATENT DOCUMENTS

| | | | |
|---|---|---|---|
| EP | 1 779 979 | A1 | 4/2004 |
| EP | 1 618 999 | B1 | 1/2006 |
| GB | 2 154 497 | | 9/1985 |
| GB | 2 256 905 | A | 12/1992 |
| JP | 2004-174707 | | 6/2004 |
| JP | 2005-040880 | | 2/2005 |
| WO | WO 2004/082897 | A1 | 9/2004 |
| WO | WO 2005/092575 | A1 | 10/2005 |
| WO | WO 2005/105386 | A1 | 11/2005 |
| WO | WO 2006/041139 | A1 | 4/2006 |

* cited by examiner

ELECTRICAL POWER TOOL WITH ANTI-VIBRATION MECHANISMS OF DIFFERENT TYPES

TECHNICAL FIELD

The present invention relates to an electrical power tool and more specifically, to an electrical power tool having a vibration control mechanism.

BACKGROUND ART

Conventionally, electrical power tools having vibration control mechanisms have been proposed. For example, Japanese Patent Application Publication No. 2005-040880 discloses an electrical power tool including a casing that has a handle, a motor casing, and a gear casing connected with one another. An electrical motor is accommodated in the motor housing. A motion conversion mechanism that converts a rotation motion of the electrical motor into a reciprocation motion is provided in the gear casing. A cylinder extending a direction perpendicular to the rotation axis of the electrical motor is provided in the gear casing. A tool support portion is provided on the front side of the cylinder and is capable of attaching or detaching a working tool.

A piston is provided in the cylinder and is slidably provided along the inner periphery of the cylinder. The piston reciprocates along the inner periphery of the cylinder by the motion conversion mechanism. A striking member is provided in the front section of the cylinder and is slidably provided along the inner periphery of the cylinder. An air chamber is formed in the cylinder between the piston and the striking member. An intermediate member is provided in the front side of the striking member and is slidably provided back-and-forth within the cylinder. The working tool mentioned above is positioned at the front side of the intermediate member.

The rotational driving force of the electrical motor is transmitted to the motion conversion mechanism, and the motion conversion mechanism moves the piston in the cylinder in the reciprocation motion. The reciprocation motion of the piston repeatedly increases and decreases the pressure of the air in the air chamber, thereby applying an impact force to the striking member. The striking member moves forward and collides with the rear end of the intermediate member, thereby applying the impact force to the working tool. The workpiece is fractured by the impact force applied to the working tool.

DISCLOSURE OF INVENTION

However, in the electrical power tool described above, a vibration is generated by driving the striking member, thereby reducing operability of the electrical power tool.

In view of the foregoing, it is an object of the present invention to provide an electrical power tool that is capable of reducing the vibration resulting from the striking member and improves the operation of the electrical power tool.

This and other object of the present invention will be attained by an electrical power tool including a motor, a casing, a casing, a piston, an intermediate shaft, a motion conversion mechanism, and a plurality of types of anti-vibration mechanism. The motor has a drive shaft. The casing accommodates at least the motor. The piston is driven by a rotary motion of the drive shaft. The intermediate shaft extends parallel to the drive shaft and is driven to rotate by the rotary motion of the drive shaft, the intermediate shaft defining an axial direction. The motion conversion mechanism is disposed on the intermediate shaft and is capable of moving in association with the intermediate shaft for converting the rotary motion of the drive shaft to a reciprocating motion. The motion conversion mechanism includes a first motion conversion mechanism that is connected to the piston and moves the piston in a reciprocating motion in directions substantially parallel to the axial direction of the intermediate shaft. The plurality of types of anti-vibration mechanism is accommodated in the casing.

Preferably, the plurality of anti-vibration mechanisms includes a compulsive anti-vibration mechanism and a passive anti-vibration mechanism.

Preferably, the compulsive anti-vibration mechanism includes a first counterweight capable of reciprocating in directions substantially parallel to the axial direction of the intermediate shaft in opposite phase to and in interlocking relation to the reciprocating motion of the piston. The passive anti-vibration mechanism includes a second counterweight capable of reciprocating in directions of the reciprocating motion of the piston due to a vibration applied to the motor and the casing.

With this arrangement, vibration related to the reciprocating motion of the piston can be reduced by the counterweight.

Preferably, the counterweight has a mass substantially the same as that of the piston.

Preferably, the motion conversion mechanism further includes a second motion conversion mechanism. The first counterweight is connected to the second motion conversion mechanism so as to be capable of reciprocating in opposite phase to the reciprocating motion of the piston.

With this arrangement, vibration related to the reciprocating motion of the piston can be reduced by the counterweight effectively.

Preferably, the first motion conversion mechanism has a configuration substantially the same as that of the second motion conversion mechanism.

With this arrangement, vibration related to the reciprocating motion of the piston can be reduced effectively.

Preferably, each of the first counterweight and the piston has a center of gravity. The first motion conversion mechanism and the second motion conversion mechanism are aligned along a straight line parallel to a straight line connecting the centers of gravity of the first counterweight and the piston.

Preferably, each of the first counterweight and the piston has a center of gravity positioned on a straight line parallel to the axial direction of the intermediate shaft.

With these arrangements, the first motion conversion mechanism and the first motion mechanism can be disposed on a same axis, and the piston and the counterweight can be disposed on a same axis. Accordingly, vibration related to the reciprocating motion of the piston can be reduced effectively.

Preferably, the first motion conversion mechanism has a first end part that is capable of pivoting reciprocatingly along the axial direction of the intermediate shaft, and a second end part located at a position opposite to the first end part with respect to the intermediate shaft. The piston is connected to the first end part so as to be capable of reciprocating. The first counterweight is connected to the second end part so as to be capable of reciprocating.

With this arrangement, the counterweight can be located on an opposite side of the intermediate shaft from the piston and the length of casing can be shortened.

Preferably, the piston, the first counterweight, the first end part, and the second end part provide a sum of momentums which is approximately 0 when the piston, the first counterweight, the first end part, and the second end part reciprocate.

With this arrangement, vibration related to the reciprocating motion of the piston can be reduced by the counterweight effectively.

Preferably, the passive anti-vibration mechanism has a neutral position in non-operational phase of the motor. The passive anti-vibration mechanism includes an elastically deforming member configured to bias the second counterweight to return to the neutral position.

With this arrangement, vibration related to the driving of the striking member can be reduced, thereby improving the operability of the electrical power tool.

Preferably, the casing includes a motor casing accommodating the motor, and a gear casing accommodating the piston, the intermediate shaft, the motion conversion mechanism, and the first counterweight. The passive anti-vibration mechanism is disposed between the motor casing and the gear casing.

With this arrangement, the dynamic vibration absorber can be provided between the motor casing and the gear casing, and the motor casing and the gear casing can be designed with a compact radial dimension.

Preferably, the casing has an outer periphery. The anti-vibration mechanism is provided on the outer periphery of the casing.

With this arrangement, the dynamic vibration absorber are provided on the casing, enabling electrical power tool to be made compact without excessively increasing length thereof.

Preferably, the passive anti-vibration mechanism includes a holding casing connected to the outer periphery of the casing. The elastically deforming member is disposed inside the holding casing and extending in a direction parallel to the axial direction of the intermediate shaft. The second counterweight is disposed inside the holding casing and is supported by the elastically deforming member.

Preferably, the passive anti-vibration mechanism further includes a holding member connected to the casing. The elastically deforming member extends from the holding member in a direction substantially orthogonal to the axial direction of the intermediate shaft. The second counterweight is attached to the elastically deforming member.

With this arrangement, the second counterweight can be reciprocate according to vibration generating on the electrical power tool against the biasing force of the elastically deforming member.

DESCRIPTION OF REFERENCE NUMERALS

Figure 1:
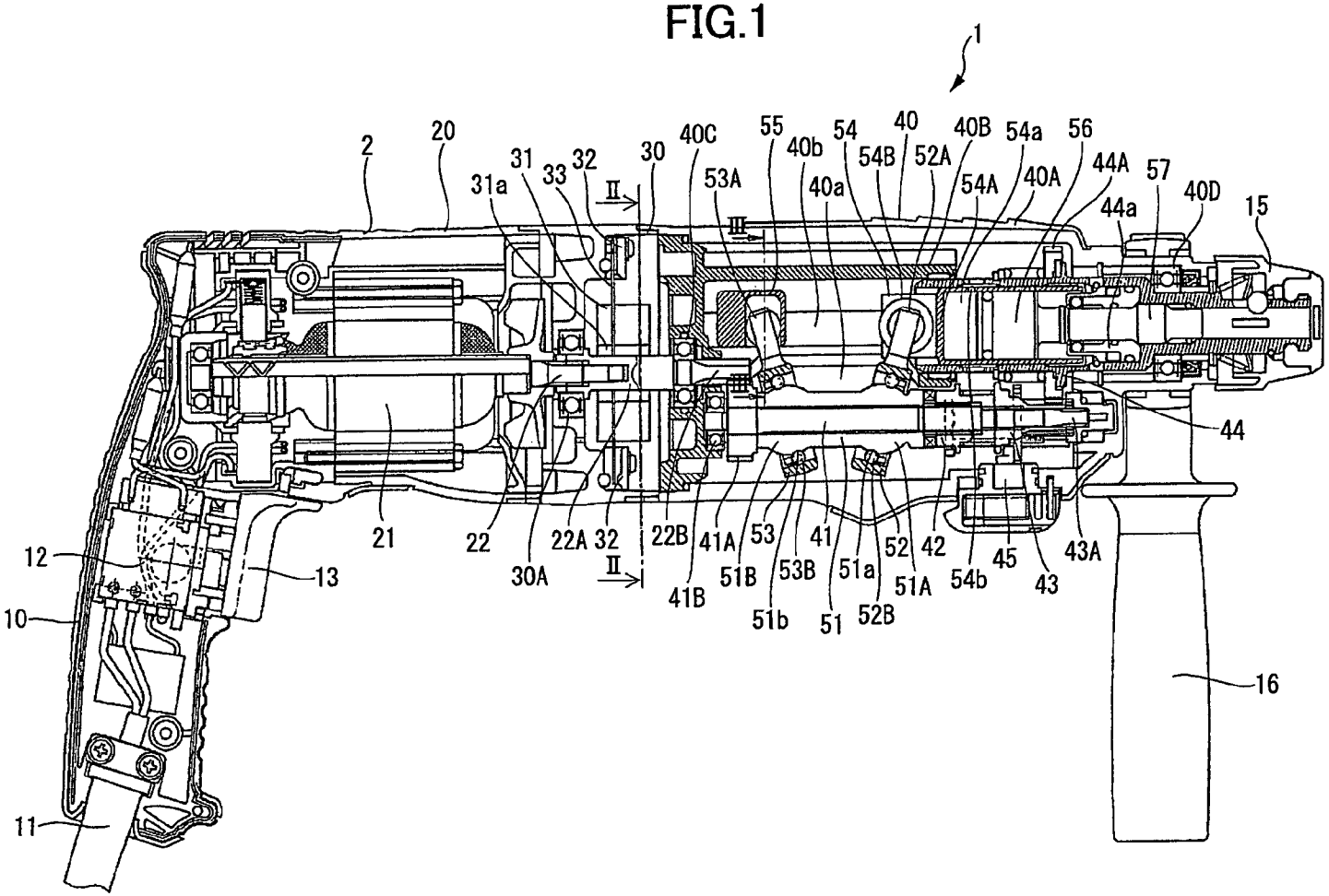
FIG. 1 is a side cross-sectional view of an electrical power tool according to a first embodiment of the present invention.

1 impact tool
2 casing
10 handle
11 power cable
12 switch mechanism
13 trigger
15 tool holder
16 side handle
20 motor casing
21 electrical motor
22 output shaft
22A extended shaft
22B first gear
30 weight casing
30A bearing
31 first weight
31*a* through-hole
32 connecting member
33 weight-supporting member
33A screw
40 gear casing
40A first gear casing
40B second gear casing
40C bearing
40D bearing
40*a* reduction chamber
40*b* groove
41 intermediate shaft
41A second gear
41B bearing
42 first clutch
43 second clutch
43A third gear
44 cylinder
44A fourth gear
44*a* space
45 lever
51 cam member
51*a*,51*b* groove
51A first cam
51B second cam
52 first motion conversion member
52A first arm
52B ball
53 second motion conversion member
53A second arm
53B ball
54 piston
54A cylinder part
54B connecting part
54*a* air chamber
54*b* air hole
55 second weight
56 striking member
57 intermediate member

BEST MODE FOR CARRYING OUT THE INVENTION

A first embodiment applying an electrical power tool of the present invention to an impact tool will be described with reference to FIGS. 1 through 4. An impact tool 1 is configured of a handle 10, and a casing 2 connected to the handle 10. The casing 2 includes a motor casing 20, a weight casing 30, and a gear casing 40.

The handle 10 extends from a side surface of the motor casing 20 opposite the side of the weight casing 30. A power cable 11 is attached to the handle 10. The handle 10 houses a switch mechanism 12. A trigger 13 that can be manipulated by the user is mechanically connected to the switch mechanism 12. The switch mechanism 12 is connected to an external power source (not shown) through the power cable 11. By operating the trigger 13, the switch mechanism 12 can be connected to and disconnected from the external power source. The side of the impact tool 1 on which the handle 10 is provided with respect to the longitudinal direction of the casing 2 will be defined as the rear side, and the opposite side in the longitudinal direction will be defined as the front side. Further, the distal end of the handle 10 extending from the casing 2 in a direction substantially orthogonal to the front-to-rear direction will be defined as the bottom side, and the opposite side will be defined as the top side.

The motor casing 20 is a resin-molded product that has been molded integrally with the handle 10. The motor casing 20 houses an electrical motor 21. The electrical motor 21 has an output shaft 22, serving as a drive shaft for outputting a rotational drive force. An extended shaft 22A is provided on the front end of the output shaft 22 for extending the length of the drive shaft in order to penetrate the weight casing 30. The extended shaft 22A is supported by bearings 30A and 40C described later with the front end of the extended shaft 22A positioned in the gear casing 40. A first gear 22B is provided on the front end part of the extended shaft 22A positioned in the gear casing 40.

The weight casing 30 is configured of a dynamic vibration absorber (passive anti-vibration mechanism) provided on an endface of the motor casing 20 on the opposite side from the handle 10. The bearing 30A is provided on the weight casing 30, where the weight casing 30 joins the motor casing 20, for rotatably supporting the extended shaft 22A.

Figure 2:
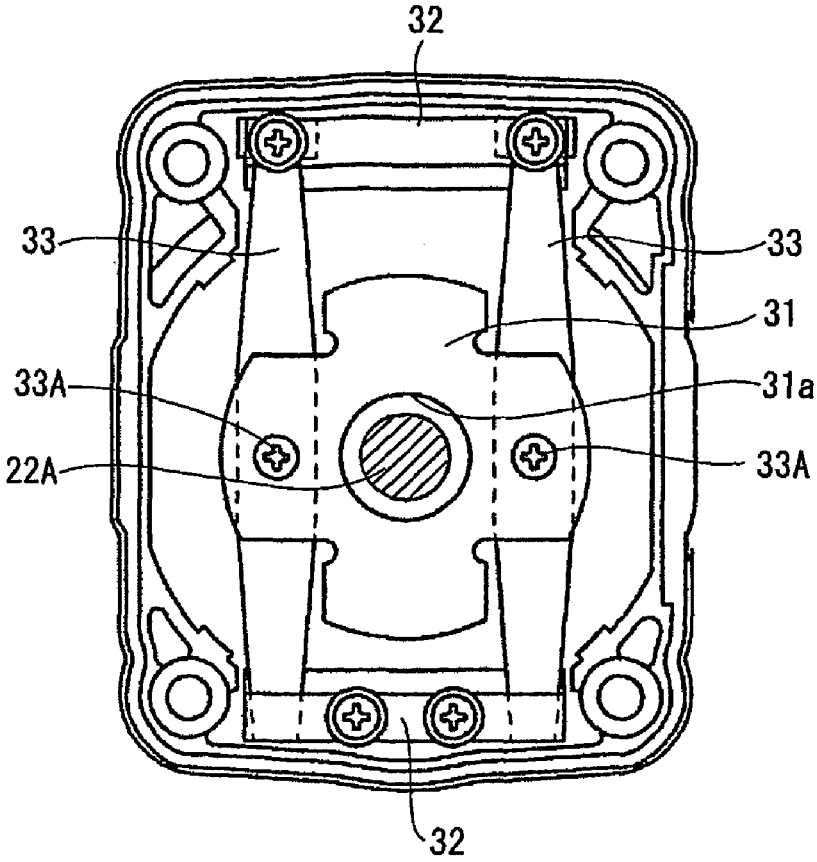
FIG. 2 is a cross-sectional view of the electrical power tool along the line II-II shown in FIG. 1.

A first weight 31 is disposed inside the weight casing 30. As shown in FIG. 2, the first weight 31 is supported in the weight casing 30 by a pair of connecting members 32 and a pair of weight-supporting members 33. More specifically, the connecting members 32 are arranged in the weight casing 30 with one at each end of a vertical direction orthogonal to the axial direction of the output shaft 22. The weight-supporting members 33 are disposed between and connected to the connecting members 32, with one end fixed to one connecting member 32 and the other end fixed to the other connecting member 32. The first weight 31 is fixed substantially to a center position of each weight-supporting member 33 with respect to the longitudinal direction of the same by screws 33A.

The weight-supporting members 33 are configured of leaf springs, both ends of which are fixed to the weight casing 30 by the connecting members 32. Further, the first weight 31 is disposed substantially at the center of the weight-supporting members 33. Therefore, the weight-supporting members 33 can vibrate with the positions of the connecting members 32 as nodes and the positions of the first weight 31 as antinodes.

A through-hole 31*a* is formed in the first weight 31 at a position corresponding to the output shaft 22 when the weight casing 30 is attached to the motor casing 20. At this time, the extended shaft 22A penetrates the through-hole 31*a*. The impact tool 1 has a center of gravity G positioned inside the weight casing 30.

The gear casing 40 is provided on the side of the weight casing 30 opposite the motor casing 20. The gear casing 40 is configured of a substantially cylindrical first gear casing 40A connected to the weight casing 30 and forming the outermost covering; and a second gear casing 40B disposed inside the first gear casing 40A for slidably supporting a second weight 55 (compulsive anti-vibration mechanism) and a piston 54 described later.

The bearing 40C described above is provided in the second gear casing 40B for rotatably supporting the extended shaft 22A. A reduction chamber 40*a* defined by the first gear casing 40A and second gear casing 40B functions to accommodate a rotation transmitting mechanism described later. A pair of grooves 40*b* (see FIG. 3) for slidably supporting the second weight 55 described later is formed in the second gear casing 40B at the location of the second weight 55.

An intermediate shaft 41 is disposed in the first gear casing 40A below the second gear casing 40B. The intermediate shaft 41 is parallel to the output shaft 22 and is rotatably supported about its axis by the first gear casing 40A and second gear casing 40B through a bearing 41B and the like. Further, a side handle 16 is provided on the front end of the first gear casing 40A.

A second gear 41A is fixed coaxially to the intermediate shaft 41 on the rear end (the end of the electrical motor 21 side) of the intermediate shaft 41 for meshingly engaging with the first gear 22B. A first clutch 42 and a second clutch 43 are sequentially juxtaposed on the front side of the second gear 41A. The first clutch 42 and second clutch 43 rotate together with the intermediate shaft 41 and are capable of sliding in the axial direction thereof. A third gear 43A capable of meshingly engaging with a fourth gear 44A described later is provided on the front side of the second clutch 43, i.e. the side opposite the first clutch 42.

A cylinder 44 is provided in the first gear casing 40A at a position near the distal end and upper side of the intermediate shaft 41. The cylinder 44 extends parallel to the intermediate shaft 41 and is rotatably supported in the second gear casing 40B through a bearing 40D and the like. The fourth gear 44A is rotatably fixed around the outside of the cylinder 44 near the third gear 43A and is capable of rotating coaxially with the cylinder 44. Through the engagement of the third gear 43A and the fourth gear 44A, the cylinder 44 can rotate relative to the gear casing 40 about its axial center.

A space 44*a* is defined inside the cylinder 44 and is open on the front and rear sides of the cylinder 44. The piston 54 is disposed inside the space 44*a* through the rear opening in the cylinder 44 and is capable of sliding in a reciprocating direction and a circumferential direction. A tool holder 15 is provided on the front end of the cylinder 44 for mounting a working tool (not shown). The tool holder 15 allows the working tool to be inserted into the space 44*a* through the opening in the front side of the cylinder 44 and fixed in this inserted state.

The piston 54 is integrally configured of a cylinder part 54A, and a connecting part 54B. The cylinder part 54A is substantially cylindrical in shape with an open front end and a closed rear end. An air chamber 54*a* is defined inside the piston 54. A plurality of air holes 54*b* are formed in side surface of the piston 54, which are the wall portion defining the air chamber 54*a*. The outer diameter of the cylinder part 54A is substantially identical in size to the inner diameter of the space 44*a* on the rear side thereof. The connecting part 54B is provided on the rear end of the cylinder part 54A and is coupled to a first arm 52A described later.

A striking member 56 is disposed in the air chamber 54*a* of the piston 54 and is capable of slidingly reciprocating. The striking member 56 is configured to move forward by the pressure of compressed air generated in the air chamber 54*a* when the piston 54 moves from the rear side to the front side. An intermediate member 57 is slidably disposed in the space 44*a* of the cylinder 44 in the area between the piston 54 and the tool holder 15 and is capable of contacting both the striking member 56 and a working tool (not shown) held by the tool holder 15. Hence, when the striking member 56 strikes the intermediate member 57, the impact force of the striking member 56 is applied to the working tool via the intermediate member 57.

A cam member 51 is provided on the intermediate shaft 41 between the second gear 41A and the first clutch 42. The cam member 51 includes substantially spherical first and second cams 51A and 51B. The first and second cams 51A and 51B are aligned in the axial direction of the intermediate shaft 41, with the first cam 51A disposed on the first clutch 42 side, and the second cam 51B disposed on the second gear 41A side. The cam member 51 is normally not connected to the intermediate shaft 41. Hence, as long as the cam member 51 is not connected to the first clutch 42 described later, the cam member 51 will not rotate together with the intermediate shaft 41.

The first and second cams 51A and 51B are shaped symmetrically about a plane orthogonal to the axis of the intermediate shaft 41. Grooves 51*a* and 51*b* are formed in the surfaces of the first and second cams 51A and 51B, respectively along the entire outer periphery of the spherical surface. Each grooves 51*a* and 51*b* is formed on an imaginary plane intersecting the axis of the intermediate shaft 41. First and second motion conversion members 52 and 53 having similar shapes are provided on the first and second cams 51A and 51B, respectively. More specifically, the first motion conversion member 52 is substantially annular in shape and is provided with a plurality of balls 52B along the inside of the annular shape. The first motion conversion member 52 is mounted on the first cam 51A, with the balls 52B engaged in the groove 51*a*. The first arm 52A extends from the top surface of first motion conversion member 52 and couples with the rear end part (the connecting part 54B) of the piston 54. The first cam 51A, first motion conversion member 52, and balls 52B constitute a first motion conversion mechanism.

As with the first motion conversion member 52, the second motion conversion member 53 is mounted on the second cam 51B with a plurality of balls 53B inserted into the groove 51*b*. A second arm 53A extends from the second motion conversion member 53 and connects to the second weight 55. The second cam 51B, second motion conversion member 53, and balls 53B constitute the second motion conversion mechanism. Hence, the first and second motion conversion mechanisms have substantially the same shape and construction and are disposed on the intermediate shaft 41 so that both mechanisms are aligned along an axis parallel to the axis of the intermediate shaft 41.

Figure 3:
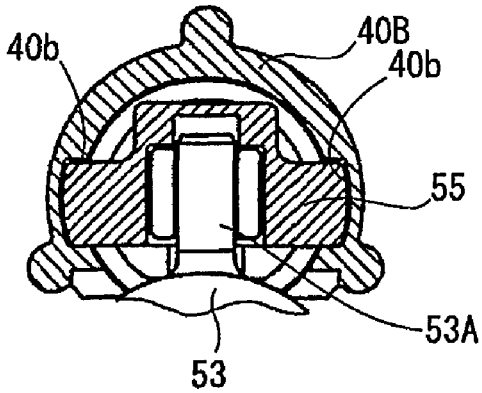
FIG. 3 is a cross-sectional view of the electrical power tool along the line shown in FIG. 1.

The second weight 55 is configured to have the same mass as the piston 54. As shown in FIG. 3, parts on both sides of the second weight 55 are inserted into the grooves 40*b* so that the second weight 55 can slide within the second gear casing 40B. The second weight 55 is also arranged so that an axis extending from the center of gravity of the second weight 55 to the center of gravity of the piston 54 is parallel to the axial direction of the intermediate shaft 41.

A lever 45 is provided below the first gear casing 40A at a position near the first and second clutches 42 and 43. When operated by the user, the lever 45 can slide the first and second clutches 42 and 43 forward or rearward. More specifically, by sliding the first clutch 42 rearward with the lever 45, the first clutch 42 couples with the cam member 51 so that the cam member 51 rotates together with the first clutch 42. Further, by sliding the second clutch 43 forward with the lever 45, the third gear 43A meshes with the fourth gear 44A so that the cylinder 44 rotates together with the second clutch 43. Since the first and second clutches 42 and 43 always rotate together with the intermediate shaft 41, the lever 45 can control the connected and unconnected states of the intermediate shaft 41 with the cam member 51 and the cylinder 44.

With the impact tool 1 having the construction described above, the user first operates the lever 45 to select whether the working tool is driven to rotate, driven to strike, or both.

When the working tool is driven to both rotate and strike, the first clutch 42 and cam member 51 are engaged, and the third gear 43A of the second clutch 43 is meshed with the fourth gear 44A of the cylinder 44.

When the cylinder 44 rotates, the working tool (not shown) mounted in the end of the cylinder 44 rotates together with the cylinder 44.

While the cam member 51 rotates around the intermediate shaft 41, the first motion conversion member 52 does not rotate together with the first cam 51A around the intermediate shaft 41 since the first motion conversion member 52 is connected to the first cam 51A through the balls 52B. However, the groove 51*a* in which the balls 52B are accommodated is formed on the plane crossing the intermediate shaft 41, enabling the first arm 52A to pivot reciprocatingly in the axial direction of the intermediate shaft 41. Hence, the piston 54 connected to the first arm 52A can also reciprocate. When the piston 54 moves from the rear side to the front side, air in the air chamber 54*a* formed between the cylinder part 54A and the striking member 56 is compressed, producing a reaction force that moves the striking member 56 rapidly forward. The striking member 56 strikes the intermediate part 57, which in turn applies an impact force to the working tool.

Figure 4:
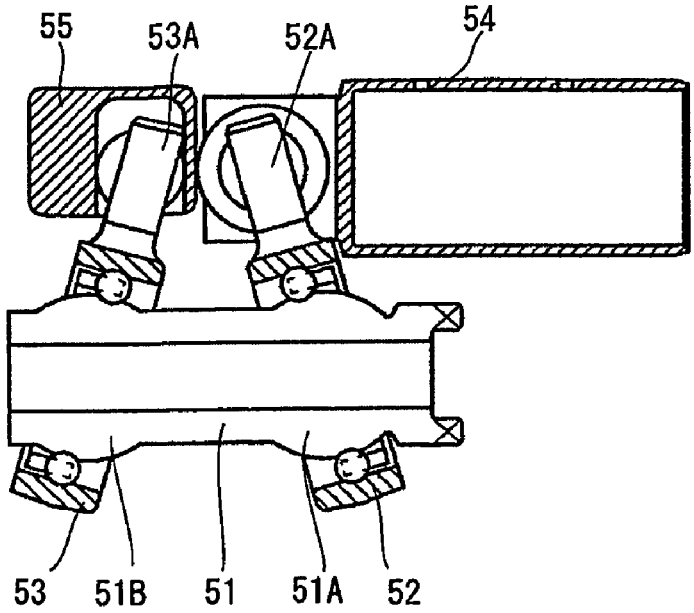
FIG. 4 is a view illustrating motion of a piston and counterweight in the electrical power tool according to the first embodiment.

As with the first motion conversion member 52, the second motion conversion member 53 also pivots without rotating. However, since the second cam 51B is formed symmetrical to the first cam 51A, the phase of pivoting for the second motion conversion member 53 is opposite that for the first motion conversion member 52. Hence, when the piston 54 moves forward, the second weight 55 moves rearward, as shown in FIG. 1. When the piston 54 moves rearward, the second weight 55 moves forward, as shown in FIG. 4. The second weight 55 reciprocates in interlocking relation to the piston 54. The piston 54 and second weight 55 have the same mass and centers of gravity of the piston 54 and second weight 55 are located on a same position in the reciprocating direction. Further, the first and second motion conversion members 52 and 53 have similar shapes and are positioned on a straight line parallel to a line connecting the centers of gravity of the piston 54 and second weight 55. Hence, the momentum of the second weight cancels momentum of the piston 54, thereby reducing vibration generated when the piston 54 reciprocates.

In addition to the vibration related to the reciprocal movement of the piston 54 in the operations of the impact tool 1, the reciprocating motion of the striking member 56 generates vibration. The vibration are transferred to the connecting member 32 via the weight casing 30 and are subsequently transferred to the weight-supporting member 33 and the first weight 31 so that the first weight 31 vibrates in the same direction that the piston 54 reciprocates. The vibration of the first weight 31 can further reduce vibrations in the impact tool 1 caused by the reciprocating motion of the striking member 56, thereby improving the operability of the impact tool 1.

Since the first weight 31 is disposed inside the weight casing 30, the cylindrical weight casing 30 can be designed with a compact radial dimension. In other words, the impact tool 1 can be configured without increasing the diameter of the casing 2. Hence, the impact tool 1 can be used to perform operations in difficult areas, such as near walls and the like, without loss in operability.

Figure 5:
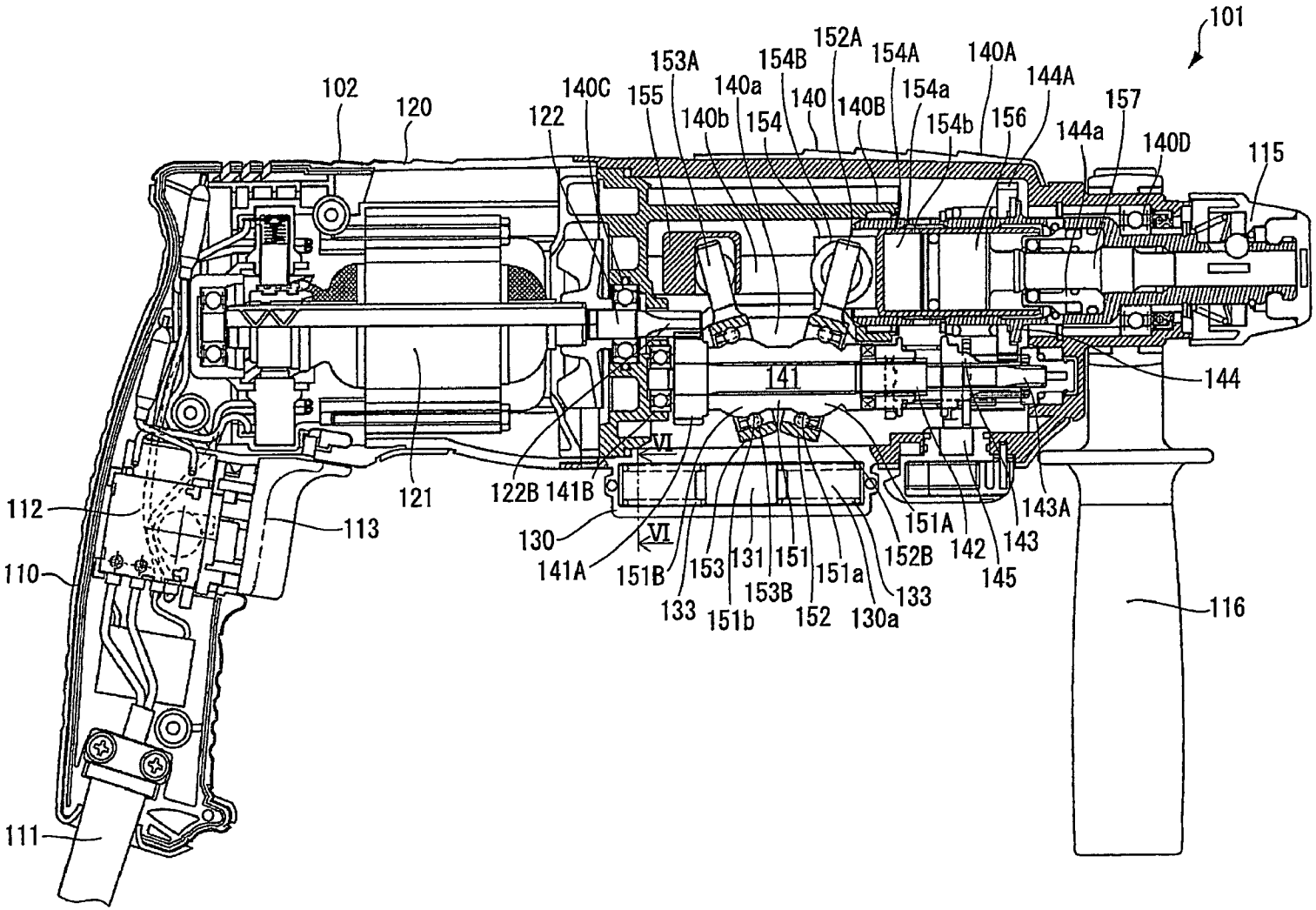
FIG. 5 is a side cross-sectional view of an electrical power tool according to a second embodiment of the present invention.

Next, an electrical power tool according to a second embodiment of the present invention will be described with reference to FIGS. 5 and 6. FIG. 5 shows an impact tool 101, serving as the electrical power tool according to the second embodiment. Except for the structure related to the dynamic vibration absorber (the structure related to the weight casing 30 in the first embodiment), the structure of the impact tool 101 is identical to the impact tool 1 according to the first embodiment. Accordingly, the value "100" has been added to parts constituting the same structure as the impact tool 1 in the first embodiment, and a detailed description of these parts has been omitted.

Figure 6:
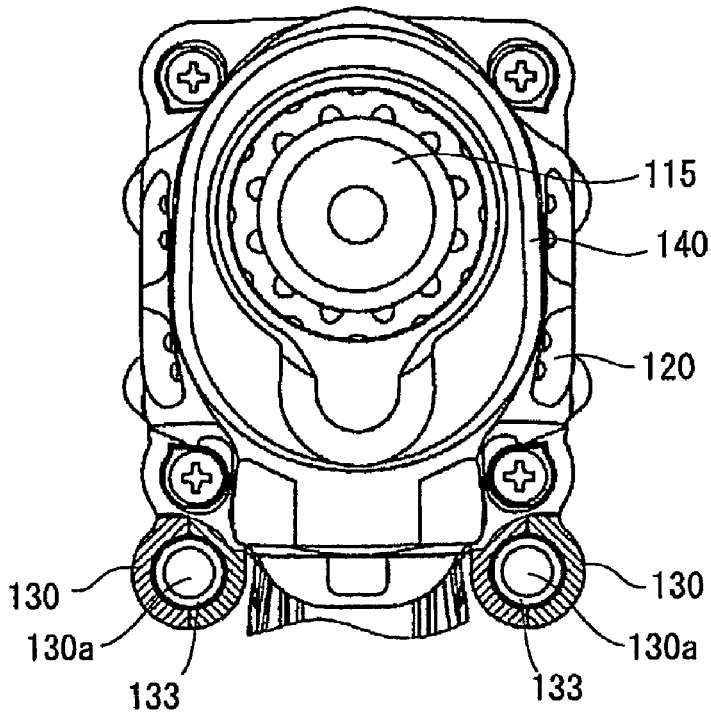
FIG. 6 is a partial cross-sectional view of the electrical power tool along the line VI-VI shown in FIG. 5.

As shown in FIG. 6, the impact tool 101 has a gear casing 140, and a pair of weight casings 130 provided below the first gear casing 140A constituting the outermost portion of the gear casing 140. Since the weight casings 130 are formed in substantially the same shape, only the single weight casing 130 shown in FIG. 5 will be described.

As shown in FIG. 6, a space 130*a* is formed in the weight casing 130 with a circular cross section taken orthogonal to the front-to-rear direction. As shown in FIG. 5, a first weight 131, and a pair of weight-supporting members 133 is disposed inside the space 130*a*. The first weight 131 is capable of sliding in the front-to-rear direction inside the space 130*a*. The weight-supporting members 133 are configured of coil springs disposed one on the front and rear sides of the first weight 131 for elastically supporting the same.

When the user operates the impact tool 101 having this construction, vibration related to the reciprocating motion of a piston 154 are suppressed or reduced by a second weight 155 that has substantially the same mass as the piston 154, but reciprocates in the opposite phase. In addition to sliding related to the reciprocating piston 154 during operations of the impact tool 101, reciprocating motion of a striking member 156 occurring when the piston 154 impacts an intermediate member 157 connected to the working tool (not shown) and when the intermediate member 157 in turn strikes the striking member 156 also produces vibration. The vibration are transferred to the weight casing 130 via a cylinder 144 housing the striking member 156, and the first gear casing 140A supporting the cylinder 144.

Since the first weight 131 is disposed in the space within the weight casing 130 so as to be capable of sliding in the front-to-rear direction, vibration transmitted to the weight casing 130 causes the first weight 131 to slidably reciprocate relative to the weight casing 130 in the front-to-rear direction. However, the first weight 131 is elastically supported by the weight-supporting members 133, which absorb kinetic energy related to the sliding of the first weight 131. Hence, the first weight 131 reduces vibrations in the impact tool 101 caused by the striking member 156 and the like, while the weight-supporting members 133 absorb vibrations generated by the reciprocating first weight 131, thereby improving operability of the impact tool 101.

In the impact tool 101 according to the second embodiment, the weight casings 130 are provided on the gear casing 140, enabling the impact tool 101 to be made more compact without excessively increasing the front-to-rear length thereof. While the weight casings 130 may conceivably be mounted in different locations, such as on a motor casing 120 or above the gear casing 140, these weight casings 130 are preferably disposed at positions on the bottom of the gear casing 140, as shown in FIG. 5. Hence, when performing difficult operations near a wall or the like, this positioning prevents the gear casing 140 from interfering with the wall, thereby preventing a loss of operability.

Figure 7:
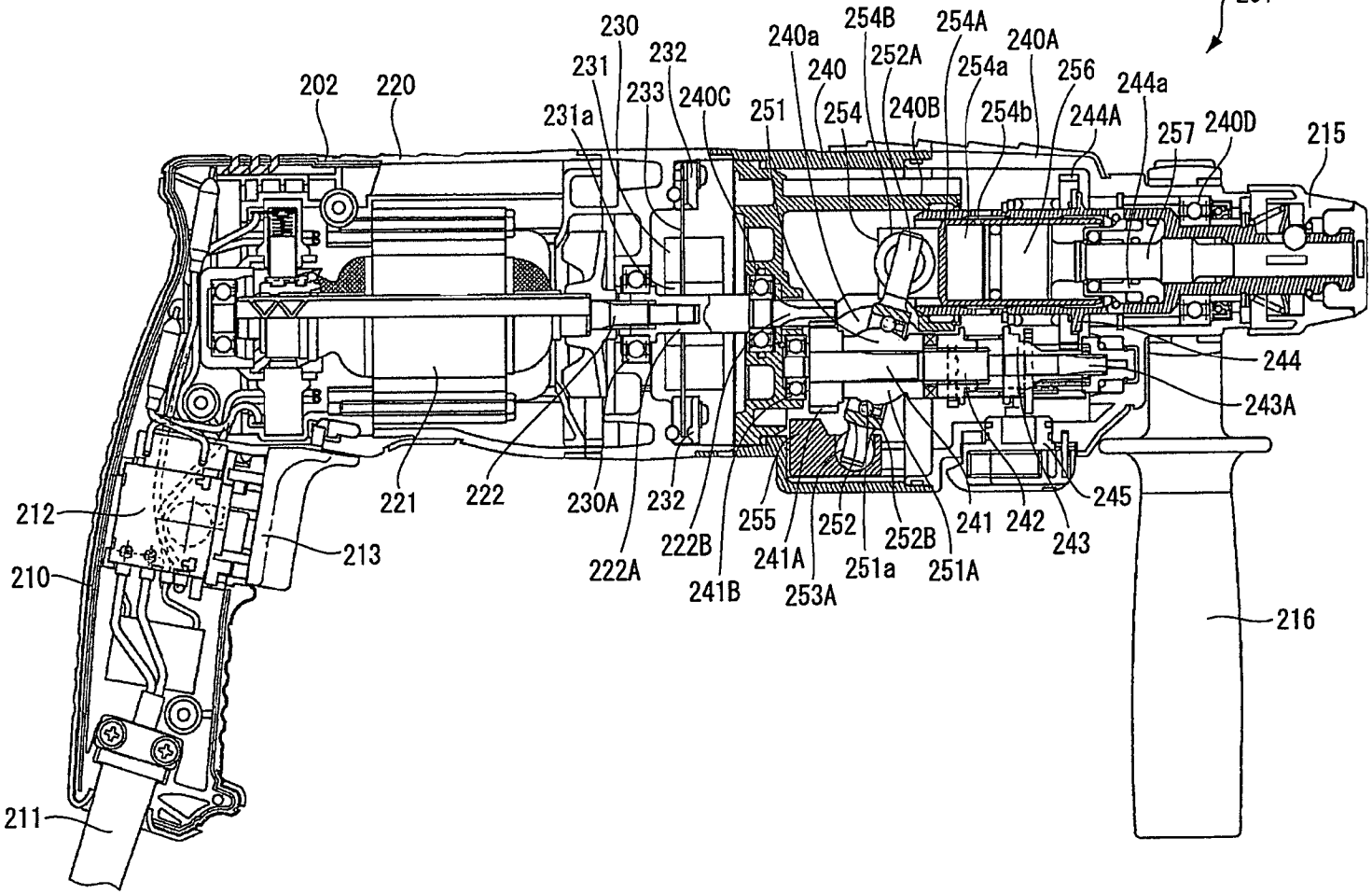
FIG. 7 is a side cross-sectional view of an electrical power tool according to a third embodiment of the present invention.

Next, an electrical power tool according to a third embodiment of the present invention will be described with reference to FIG. 7. FIG. 7 shows an impact tool 201, which serves as the electrical power tool according to the third embodiment. Except for the structure related to the motion conversion mechanisms (the cam part 51 and related structure according to the first embodiment), the impact tool 201 is identical in structure to the impact tool 1 of the first embodiment. Accordingly, the value "200" has been added to components identical to those in the first embodiment, and a detailed description of these components will not be repeated.

As shown in FIG. 7, a cam member 251 is disposed between a second gear 241A and a first clutch 242 on an intermediate shaft 241 functioning to transmit output from an electrical motor 221 to a cylinder 244 and a piston 254. The cam member 251 is configured to rotate coaxially with the intermediate shaft 241 only when connected to the first clutch 242. A substantially spherical cam 251A is provided on the cam member 251. A groove 251*a* is formed in the surface of the cam 251A along the entire outer spherical surface. The groove 251*a* is formed on an imaginary plane intersecting the axis of the intermediate shaft 241. A motion conversion member 252 is provided on the cam 251A. The motion conversion member 252 is substantially annular in shape and is provided with a plurality of balls 252B along the inner surface of the annular portion. The motion conversion member 252 is mounted on the cam 251A with the balls 252B engaged in the groove 251*a*. A first arm 252A extends from the top surface of the motion conversion member 252 and couples with a rear end part (a connecting part 254B) of the piston 254. A second arm 253A extends from a side surface of the motion conversion member 252 positioned on the end opposite the first arm 252A relative to the intermediate shaft 241 and couples with a second weight 255 described below. The length of the second arm 253A and the position of the center of gravity thereof need not be symmetrical to the first arm 252A with respect to the annular portion of the motion conversion member 252.

The second weight 255 is disposed inside the first gear casing 240A and is capable of sliding in the front-to-rear direction on the opposite side of the intermediate shaft 241 from the piston 254. The second weight 255 is connected to the second arm 253A. Accordingly, the second weight 255 and piston 254 are disposed on opposite sides of the motion conversion member 252 and, therefore, move in opposite phases. The second weight 255 is configured of a mass that has been preset so that the sum of momentums among the second weight 255, second arm 253A, first arm 252A, and piston 254 equals 0 when the motion conversion member 252 is driven.

When the user operates the impact tool 201 having the construction described above, the vibration related to the reciprocating piston 254 are suppressed and reduced by the second weight 255 reciprocating in an opposite phase to the piston 254. Here, it is conceivable that the difference in mass and center of gravity between the first arm 252A and second arm 253A may produce vibration. However, the sum of momentums can be adjusted to a value of 0 by adjusting the mass of the second weight 255. Hence, the vibration related to the piston 254 and second weight 255 driven by the motion conversion member 252 can be suppressed or reduced.

Further, as described in the first embodiment, a first weight 231 can suppress vibration generated by a striking member 256 and the like that are not absorbed by the second weight 255, thereby improving the operability of the impact tool 201.

Since the piston 254 and second weight 255 are aligned in the direction orthogonal to the front-to-rear direction in the impact tool 201 according to the third embodiment, the length of the first gear casing 240A in the front-to-rear direction can be shortened. Accordingly, the impact tool 201 can be made more compact.

While the electrical power tool of the invention has been described in detail with reference to specific embodiments thereof, it would be apparent to those skilled in the art that many modifications and variations may be made therein without departing from the spirit of the invention, the scope of which is defined by the attached claims. For example, the structure of the dynamic vibration absorber according to the second embodiment may be combined with the structure of the motion conversion member according to the third embodiment. With this configuration, the weight casing constituting the dynamic vibration absorber need not be interposed between the gear casing and the motor casing, and the length of the gear casing can be reduced. Accordingly, the front-to-rear length of the electrical power tool can be further shortened, making the electrical power tool more compact.

The electrical power tool according to the present invention can be applied to a wide variety of tools performing hammering or striking operations, such as a hammer drill and a jackhammer.

The invention claimed is:

1. An electrical power tool comprising:

a motor having a drive shaft;

a casing accommodating at least the motor;

a piston driven by a rotary motion of the drive shaft;

an intermediate shaft extending parallel to the drive shaft and driven to rotate by the rotary motion of the drive shaft, the intermediate shaft defining an axial direction;

a motion conversion mechanism disposed on the intermediate shaft and capable of moving in association with the intermediate shaft for converting the rotary motion of the drive shaft to a reciprocating motion, the motion conversion mechanism comprising a first motion conversion mechanism that is connected to the piston and moves the piston in a reciprocating motion in directions substantially parallel to the axial direction of the intermediate shaft; and a plurality of anti-vibration mechanisms of different types accommodated in the casing;

wherein the plurality of anti-vibration mechanisms of different types comprise at least one compulsive anti-vibration mechanism and at least one passive anti-vibration mechanism;

wherein the compulsive anti-vibration mechanism includes a first counterweight capable of reciprocating in directions substantially parallel to the axial direction of the intermediate shaft in opposite phase to and in interlocking relation to the reciprocating motion of the piston;

wherein the passive anti-vibration mechanism includes a second counterweight capable of reciprocating in directions of the reciprocating motion of the piston due to a vibration applied to the motor and the casing;

wherein the motion conversion mechanism further comprises a second motion conversion mechanism; and wherein the first counterweight is connected to the second motion conversion mechanism so as to be capable of reciprocating in opposite phase to the reciprocating motion of the piston.

2. The electrical power tool as claimed in claim 1, wherein the first counterweight has a mass substantially the same as that of the piston.

3. The electrical power tool as claimed in claim 1, wherein the first motion conversion mechanism has a configuration substantially the same as that of the second motion conversion mechanism.

4. The electrical power tool as claimed in claim 1, wherein each of the first counterweight and the piston has a center of gravity, the first motion conversion mechanism and the second motion conversion mechanism being aligned along a straight line parallel to a straight line connecting the centers of gravity of the first counterweight and the piston.

5. The electrical power tool as claimed in claim 1, wherein the first motion conversion mechanism has a first end part that is capable of pivoting reciprocatingly along the axial direction of the intermediate shaft, and a second end part located at a position opposite to the first end part with respect to the intermediate shaft;

wherein the piston is connected to the first end part so as to be capable of reciprocating; and wherein the first counterweight is connected to the second end part so as to be capable of reciprocating.

6. The electrical power tool as claimed in claim 5, wherein the piston, the first counterweight, the first end part, and the second end part provide a sum of momentums which is approximately 0 when the piston, the first counterweight, the first end part, and the second end part reciprocate.

7. An electrical power tool comprising:

a motor having a drive shaft;

a casing accommodating at least the motor;

a piston driven by a rotary motion of the drive shaft;

an intermediate shaft extending parallel to the drive shaft and driven to rotate by the rotary motion of the drive shaft, the intermediate shaft defining an axial direction;

a motion conversion mechanism disposed on the intermediate shaft and capable of moving in association with the intermediate shaft for converting the rotary motion of the drive shaft to a reciprocating motion, the motion conversion mechanism comprising a first motion conversion mechanism that is connected to the piston and moves the piston in a reciprocating motion in directions substantially parallel to the axial direction of the intermediate shaft; and a plurality of anti-vibration mechanisms of different types accommodated in the casing;

wherein the plurality of anti-vibration mechanisms of different types comprise at least one compulsive anti-vibration mechanism and at least one passive anti-vibration mechanism;

wherein the compulsive anti-vibration mechanism includes a first counterweight capable of reciprocating in directions substantially parallel to the axial direction of the intermediate shaft in opposite phase to and in interlocking relation to the reciprocating motion of the piston;

wherein the passive anti-vibration mechanism includes a second counterweight capable of reciprocating in directions of the reciprocating motion of the piston due to a vibration applied to the motor and the casing; and wherein each of the first counterweight and the piston has a center of gravity positioned on a straight line parallel to the axial direction of the intermediate shaft.

8. An electrical power tool comprising:

a motor having a drive shaft;

a casing accommodating at least the motor;

a piston driven by a rotary motion of the drive shaft;

an intermediate shaft extending parallel to the drive shaft and driven to rotate by the rotary motion of the drive shaft, the intermediate shaft defining an axial direction;

a motion conversion mechanism disposed on the intermediate shaft and capable of moving in association with the intermediate shaft for converting the rotary motion of the drive shaft to a reciprocating motion, the motion conversion mechanism comprising a first motion conversion mechanism that is connected to the piston and moves the piston in a reciprocating motion in directions substantially parallel to the axial direction of the intermediate shaft; and a plurality of anti-vibration mechanisms of different types accommodated in the casing;

wherein the plurality of anti-vibration mechanisms of different types comprise at least one compulsive anti-vibration mechanism and at least one passive anti-vibration mechanism;

wherein the compulsive anti-vibration mechanism includes a first counterweight capable of reciprocating in directions substantially parallel to the axial direction of the intermediate shaft in opposite phase to and in interlocking relation to the reciprocating motion of the piston;

wherein the passive anti-vibration mechanism includes a second counterweight capable of reciprocating in directions of the reciprocating motion of the piston due to a vibration applied to the motor and the casing;

wherein the passive anti-vibration mechanism has a neutral position in non-operational phase of the motor; and wherein the passive anti-vibration mechanism further comprises an elastically deforming member configured to bias the second counterweight to return to the neutral position.

9. The electrical power tool as claimed in claim 8, wherein the casing comprises a motor casing accommodating the motor, and a gear casing accommodating the piston, the intermediate shaft, the motion conversion mechanism, and the first counterweight; and the passive anti-vibration mechanism is disposed between the motor casing and the gear casing.

10. The electrical power tool as claimed in claim 8, wherein the casing has an outer periphery, the passive anti-vibration mechanism being provided on the outer periphery of the casing.

11. The electrical power tool as claimed in claim 10, wherein the passive anti-vibration mechanism further comprises a holding casing connected to the outer periphery of the casing, the elastically deforming member disposed inside the holding casing and extending in a direction parallel to the axial direction of the intermediate shaft, the second counterweight being disposed inside the holding casing and is supported by the elastically deforming member.

12. The electrical power tool as claimed in claim 8, wherein the passive anti-vibration mechanism further comprises a holding member connected to the casing, the elastically deforming member extending from the holding member in a direction substantially orthogonal to the axial direction of the intermediate shaft, the second counterweight being attached to the elastically deforming member.

* * * * *